US005905968A

United States Patent [19]

Staub et al.

[11] Patent Number: 5,905,968

[45] Date of Patent: May 18, 1999

[54] METHOD AND APPARATUS FOR CONTROLLING AN EARTHWORKING IMPLEMENT TO PRESERVE A CROWN ON A ROAD SURFACE

[75] Inventors: Michael D. Staub, Washington; Louis G. Alster, Morton; Steve D. Lundquist, Chillicothe, all of Ill.

[73] Assignee: Caterpillar Inc., Peoria, Ill.

[21] Appl. No.: 08/928,446

[22] Filed: Sep. 12, 1997

[51] Int. Cl.[6] ..... G05B 19/18

[52] U.S. Cl. ..... 702/150; 364/167.01; 701/50; 172/4.5

[58] Field of Search ..... 364/167.01, 167.02, 364/138, 188; 701/50, 223; 172/4.5, 417.9; 37/348; 702/95, 153, 150; 348/202

[56] References Cited

U.S. PATENT DOCUMENTS 5,612,864 3/1997 Henderson ..... 364/167.01

5,631,658 5/1997 Gudat et al. ..... 342/457

5,735,352 4/1998 Henderson et al. ..... 172/4.5

*Primary Examiner*—Kamini Shah

*Attorney, Agent, or Firm*—David M. Masterson; Steve D. Lundquist; Kevin M. Kercher

[57] ABSTRACT

A method and apparatus for controlling an earthworking implement on an earthworking machine to preserve a crown on the surface of a road, including determining the position of the crown on the road surface, choosing a sloped grade on one side of the crown, positioning the earthworking implement on the sloped grade so that a first end of the earthworking implement is on the road surface. The processor determines a desired position of a second end of the earthworking implement so that the second end overlaps the crown and the earthworking implement does not cut the crown.

25 Claims, 8 Drawing Sheets

METHOD AND APPARATUS FOR CONTROLLING AN EARTHWORKING IMPLEMENT TO PRESERVE A CROWN ON A ROAD SURFACE

The invention described herein was made in the performance of work under NASA Contract No. NCC2-9007 and is subject to the provisions of Section 305 of the National Aeronautics and Space Act of 1958 (42 U.S.C. 2457).

TECHNICAL FIELD

This invention relates generally to a method and apparatus for grading a road having a crown and, more particularly, to a method and apparatus for controlling the position of an earthworking implement to preserve the crown on the road.

BACKGROUND ART

Earthworking machines, e.g., motor graders, are used quite often to cut or scrape terrain to a desired finished contour. For example, a motor grader having an earthworking blade is used to cut the contours of a road. In this application, it is desired to shape the road so that a crown exists along a longitudinal center line of the road. The crown defines a line of highest elevation along the road, thus creating downward slopes on either side of the crown. The sloped road surface can advantageously drain water off the road, thus preventing water from accumulating on the road surface.

It is common practice to position the earthworking blade on the terrain such that one end of the blade overlaps the location of the desired crown, thereby compensating for inadvertent movements of the blade as the motor grader traverses the terrain. However, this results in a tendency to lower the blade at the overlapping end to the surface of the road, thus cutting into and altering the desired crown. A skilled operator must constantly be aware of the location of the desired crown and maintain the blade so that the overlapping end is not lowered too far.

The above problem is compounded by the development of computer-aided earthworking systems. For example, in U.S. Pat. No. 5,631,658, Gudat et al. disclose a method and apparatus for operating geography-altering machinery relative to a work site to alter the geography of the site toward a desired condition. Models of the desired and actual site geographies are stored in a database. A position receiver located on the machine determines the position of the machine relative to the site. A dynamic database receives the machine position information, determines the difference between the actual and desired site models, and updates the database in real time for display or control purposes.

In automated systems such as these, as applied to the crown control application discussed above, the overlapping end of the blade is determined to be at a particular x and y coordinate. The computer-aided earthworking system then determines from its database the corresponding z coordinate as a point on the surface of the road. The system then positions the overlapping end of the blade on this z coordinate. This results in the desired crown of the road being cut into and altered.

The present invention is directed to overcoming one or more of the problems as set forth above.

DISCLOSURE OF THE INVENTION

In one aspect of the present invention, a method for controlling an earthworking implement to preserve a crown on a road surface is disclosed. The method includes the steps of determining the position of at least one point of discontinuity of a sloped grade on the road surface, the point of discontinuity being a location of the crown, and choosing a sloped grade road surface on one of two sides of the crown. The method further includes the steps of positioning the cutting edge of an earthworking implement on the sloped grade road surface so that a first end of the cutting edge is located on the road surface, and determining a desired position of a second end of the cutting edge by determining a desired z coordinate to replace a known z coordinate.

In another aspect of the present invention, a method for controlling an earthworking implement to preserve a crown on a road surface is disclosed. The method includes the steps of determining the position of at least one point of discontinuity of a sloped grade on the road surface, the point of discontinuity being a location of the crown, and choosing a sloped grade road surface on one of two sides of the crown. The method further includes the steps of positioning the cutting edge of an earthworking implement on the sloped grade road surface so that a first end of the cutting edge is located on the road surface, and determining a desired elevation of a second end of the cutting edge.

In yet another aspect of the present invention, an apparatus for controlling an earthworking implement to preserve a crown on a road surface is disclosed. The earthworking implement is mounted on an earthworking machine and has a cutting edge with a first end and a second end. The apparatus includes a position determining system mounted on the earthworking machine, a control system located on the earthworking machine, and a database located in the control system. The apparatus also includes means for determining a position of the first end of the cutting edge, determining a position of the crown, and responsively calculating a desired position of the second end of the cutting edge.

BEST MODE FOR CARRYING OUT THE INVENTION

Figure 1:
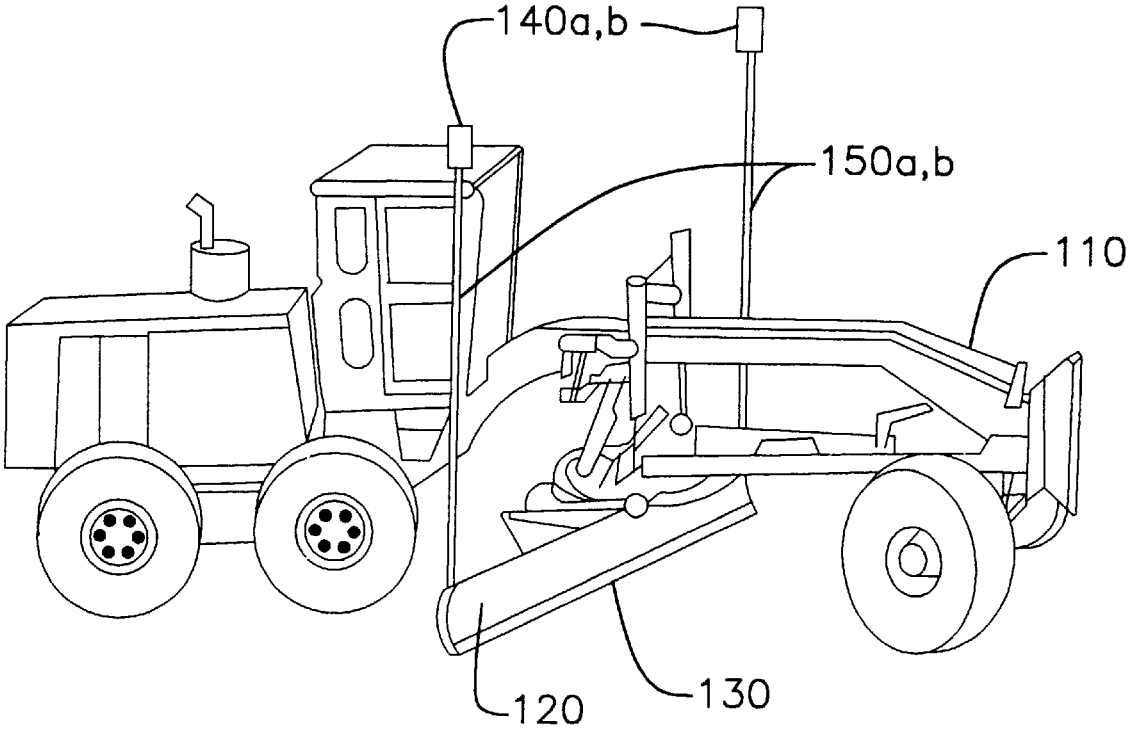
FIG. 1 is a diagrammatic illustration of an earthworking machine as embodied for use with the present invention.

The present invention is directed towards a method for controlling an earthworking implement 120 to preserve a crown 220 on a road surface 210. The road surface 210 has a sloped grade on each side of the crown 220. The earthworking implement 120 is controllably mounted on an earthworking machine 110 and has a cutting edge 130.

With particular reference to FIG. 1, the earthworking machine 110 exemplified and illustrated is a motor grader. However, it is to be understood that several other types of earthworking machines, e.g., track-type tractors, scrapers, wheel loaders, and the like, can be used in the present invention as well.

It is also to be understood that the present invention is described as preserving the crown 220 on a road surface 210, but other applications of the invention could be used as well. For example, controlling the contours associated with the construction of a parking lot or a foundation can be accomplished by use of the present invention. Additionally, the discontinuities in a road which define an edge of the road can be preserved by use of the present invention. As yet another example, the present invention could be used to preserve multiple discontinuities, e.g., a crown 220 on a road surface 210 as well as an edge of the road surface 210, by applying the present invention to more than one discontinuity simultaneously.

As shown in FIG. 1, the earthworking implement 120 is a blade. Other types of earthworking implements, e.g., scraper, bucket, could also be used. The earthworking implement 120 is shown with a pair of masts 150*a,b*, upon each of which is mounted a position determining receiver 140*a,b*. The position determining receiver 140*a,b* may be a GPS antenna, a laser receiver, or a combination of positioning receivers.

It is to be understood that configurations other than position determining receivers mounted on masts could be used to determine the position of the earthworking implement 120. For example, a GPS antenna could be mounted on a fixed location on the earthworking machine 110, and the position of the earthworking implement 120 could be determined relative to the GPS antenna using a combination of pitch and tilt angle sensors and cylinder position sensors. The use of positioning receivers to determine the position of an earthworking implement is well known in the art, and will not be discussed further.

Figure 3:
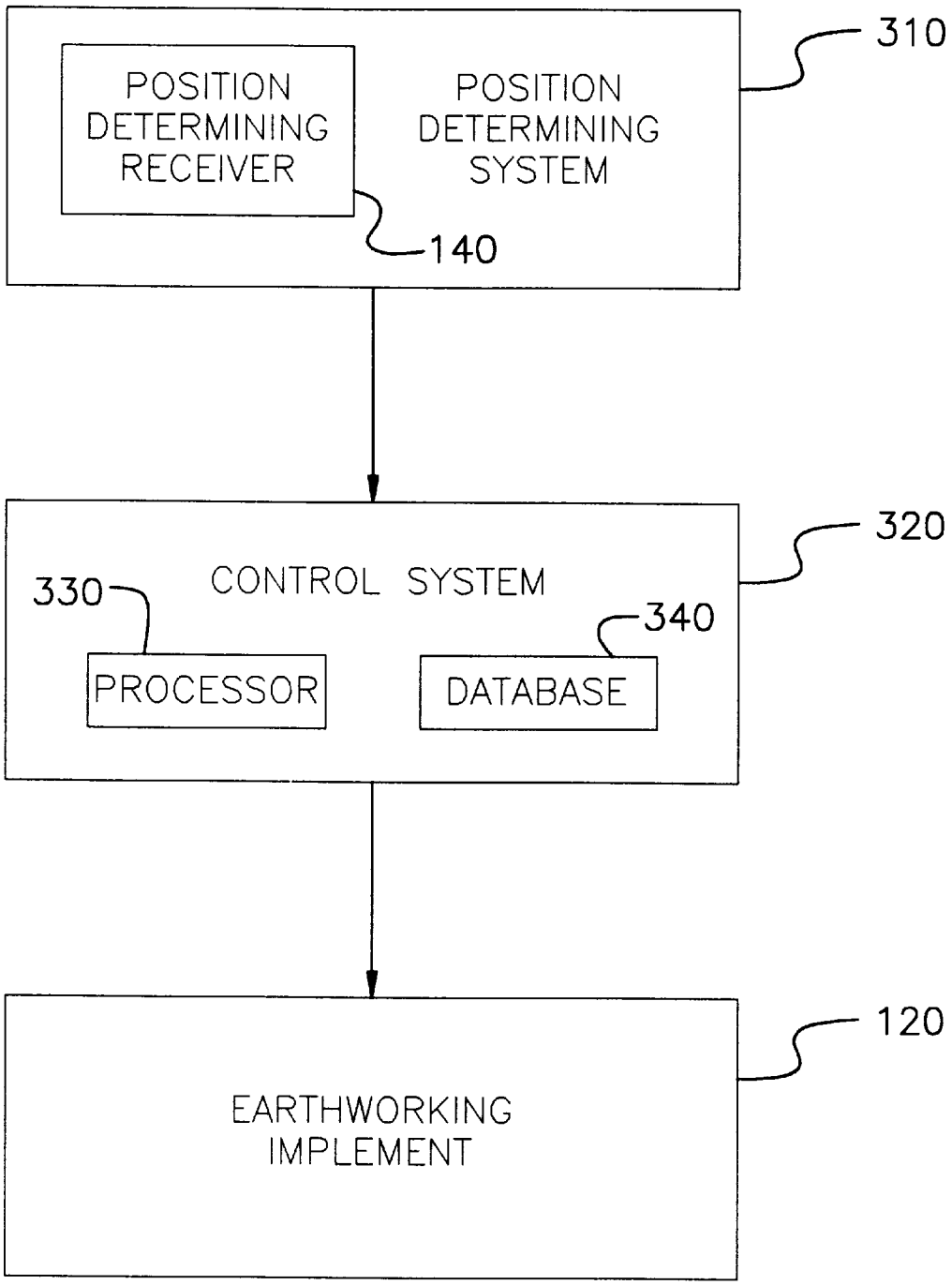
FIG. 3 is a block diagram illustrating an embodiment of the present invention.

Referring now to FIG. 3, a block diagram of a system for controlling an earthworking implement 120 is shown. A position determining system 310, which includes the position determining receiver 140, delivers a position signal to a control system 320. The control system 320 includes a processor 330, preferably a microprocessor. The control system 320 also includes a database 340, which stores information related to the desired and actual geographic terrain of the work site. The control system 320 and the database 340 are discussed in more detail below. The control system 320 delivers a control signal to the earthworking implement 120.

Figure 2:
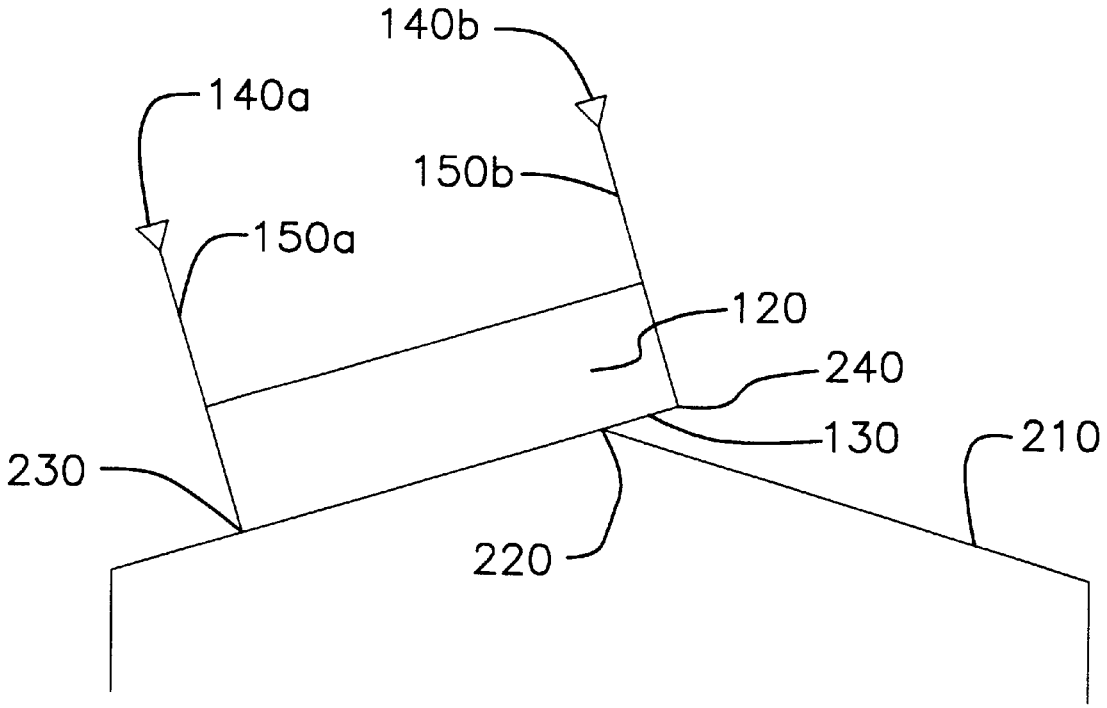
FIG. 2 is a diagrammatic illustration of a view of an earthworking implement as embodied for use with the present invention.

Referring now to FIG. 2, a diagrammatic view of the earthworking implement 120 on the road surface 210 is shown. As the earthworking machine 110 longitudinally traverses the road surface 210, it is normally desired to position the earthworking implement 120 so that one end of the cutting edge 130 overlaps the crown 220. Positioning the earthworking implement 120 in this manner maintains the crown 220 in the desired location as the earthworking machine 110 inadvertently moves from side to side during normal forward motion of the machine 110. For example, as the earthworking machine 110 encounters bumps, and the earthworking implement 120 strikes rocks, the earthworking implement 120 may shift from its desired position. Maintaining an overlap compensates for these shifts in position.

As FIG. 2 illustrates, a first end 230 of the cutting edge 130 is located on a sloped grade of the road surface 210. A second end 240 of the cutting edge 130 overlaps the crown 220 and is positioned above the opposite sloped grade of the road surface 210. In the preferred embodiment, position determining receiver 140*a*, located on mast 150*a*, determines the position of the first end 230. Position determining receiver 140*b*, located on mast 150*b*, determines the position of the second end 240.

Figure 4:
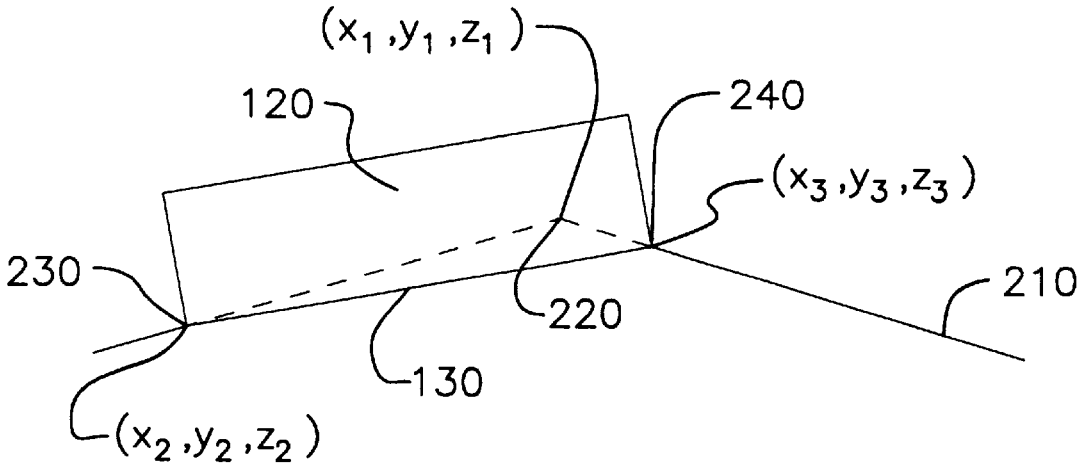
FIG. 4 is a graphical illustration of the earthworking implement as embodied in one aspect of the present invention.
Figure 5:
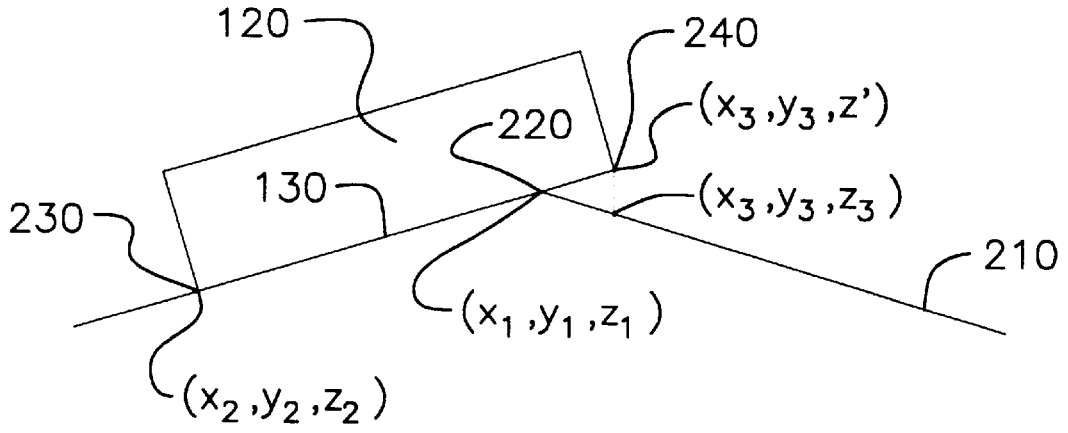
FIG. 5 is a graphical illustration of the earthworking implement as embodied in another aspect of the present invention.

Referring now to FIGS. 4 and 5, diagrammatic views illustrating two aspects of operation of the earthworking implement 120 on the road surface 210 are shown. Positions of interest are shown in Cartesian (x, y, z) coordinates. However, other types of geographical coordinate systems could be used, e.g., polar coordinates, planar coordinates, local reference coordinates, and the like.

In FIG. 4, the crown 220 is located at position $(x_1, y_1, z_1)$. The first end 230 is located at position $(x_2, y_2, z_2)$, where $x_2$ and $y_2$ are determined by position determining receiver 140*a* and $z_2$ is found from the database 340. The second end 240 is located at position $(x_3, y_3, z_3)$, where $x_3$ and $y_3$ are determined by position determining receiver 140*b* and $z_3$ is found from the database 340.

Preferably, $x_1$ and $y_1$ are found by determining an equation of a line segment defined from point $(x_2, y_2)$ to point $(x_3, y_3)$, and finding the coordinates of the intersection of this line segment with an equation of the line defining the crown 220, which is stored in the database 340. Alternatively, incremental points along the line segment from point $(x_2, y_2)$ to point $(x_3, y_3)$ are compared to the desired coordinates of the crown 220 in the database 340 until the intersection of the lines is found, which defines the desired point of the crown.

As illustrated in FIG. 4, the earthworking implement 120, in this position, removes the crown 220 from desired position $(x_1, y_1, z_1)$ and places the crown 220 at position $(X_3, y_3, z_3)$, which is lower than, and offset from, the desired position. During subsequent passes in this mode of operation, the crown 220 is progressively cut and shifted.

The mode of operation shown in FIG. 4 is caused by a natural tendency for a human operator to want to place the entire cutting edge 130 of the earthworking implement 120 on the road surface 210. An expert operator can overcome this tendency to some extent. However, the problem cannot be eliminated and becomes exacerbated over longer periods of time.

The problem illustrated in FIG. 4 becomes more prevalent if the earthworking machine 110 is controlled by a computer-aided earthworking system. Referring to FIGS. 3 and 4, the control system 320 receives x and y coordinates from the position determining system 310. The desired z coordinate for the road surface 210 at each corresponding x and y coordinate is found in the database 340. The control system 320 delivers a control signal to the earthworking implement 120 to place the cutting edge 130 on the desired z coordinates to cut the road surface 210 to the desired final contour.

As illustrated in FIG. 4, the control system 320 determines that the $x_3$ and $y_3$ coordinates have a corresponding $z_3$ coordinate. The control system 320 responsively controls the earthworking implement 120 to place the second end 240 at coordinates $(x_3, y_3, z_3)$ Referring now to FIG. 5, the crown 220 is located at position $(x_1, y_1, z_1)$. The first end 230 is located at position $(x_2, y_2, z_2)$. The second end 240 is located at position $(x_3, y_3,$ z'), where z' is located at a position directly above $z_3$ by a predetermined distance. In this mode of operation, the cutting edge 130 rests on the desired position of the crown 220. Therefore, as the earthworking machine 110 traverses the road surface 210, the desired crown 220 is maintained. It is an object of the present invention to determine the desired value of z' to preserve the crown 220 during earthworking operations.

Figure 8:
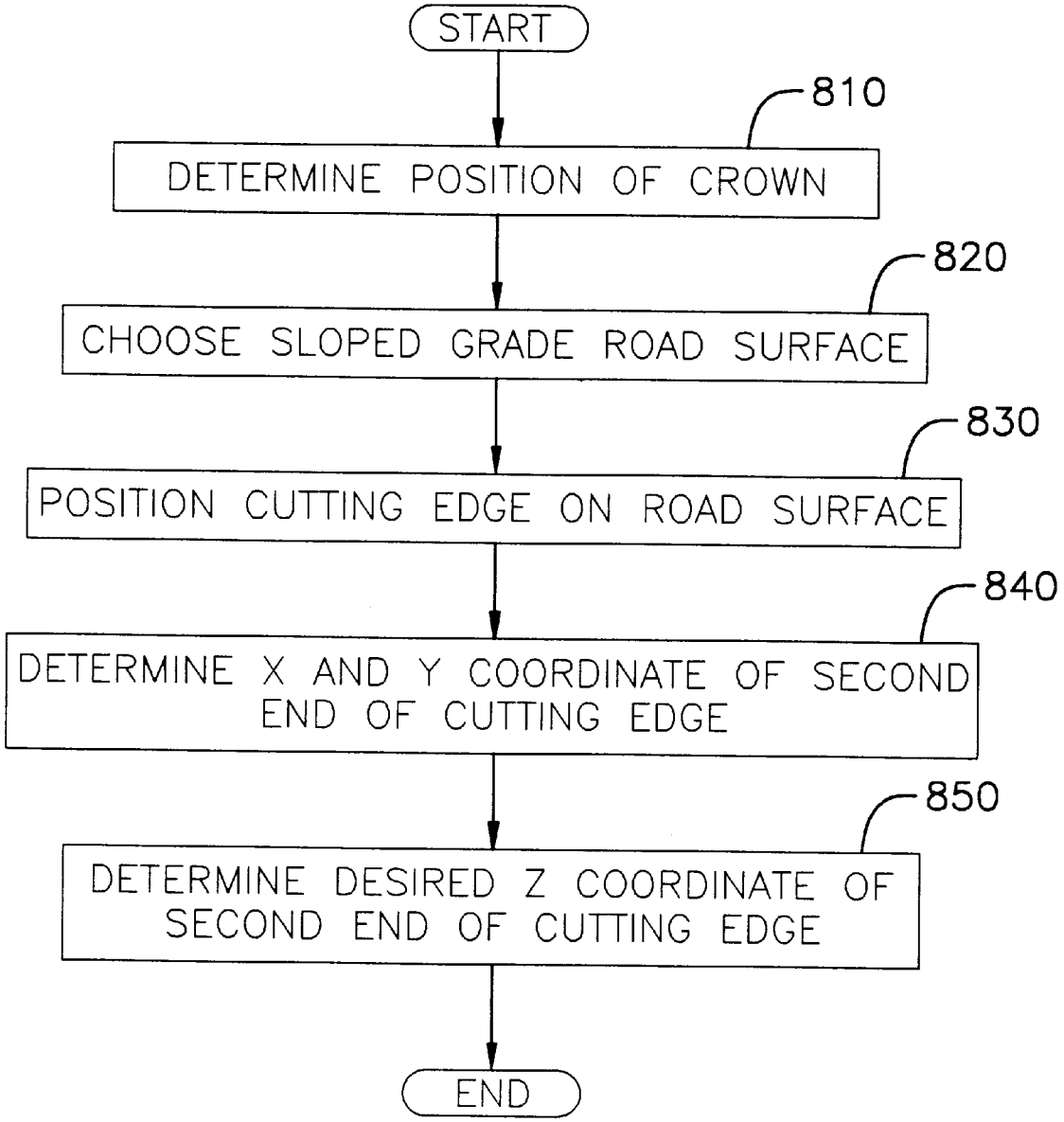
FIG. 8 is a flow diagram illustrating an aspect of the present invention.

FIG. 8 is a flow diagram which shows the steps used in an embodiment of the present invention. In a first control block 810, the position of the crown 220 is determined.

In the preferred embodiment, the crown 220 is considered to be a point of discontinuity for any line envisioned from one side of the road to the other on the road surface 210. More specifically, the road surface 210 on each side of the crown 220 has a sloped grade, which slopes downward from the crown 220 to the side edges of the road. The crown 220 is at a higher elevation than any other position on the road surface 210 along the envisioned line. Therefore, the position of the crown 220 on the line defines a point of discontinuity of the slope of the line.

As the crown 220 extends along the length of the road surface 210, a line of discontinuity is defined. The database 340 contains information defining the desired coordinates of the terrain; including, in the preferred embodiment, the geographical coordinates of the crown 220. For every x and y coordinate determined by the position determining system 310 that defines a point on the crown 220, a corresponding z coordinate, i.e., elevation, is found in the database 340.

Figure 7:
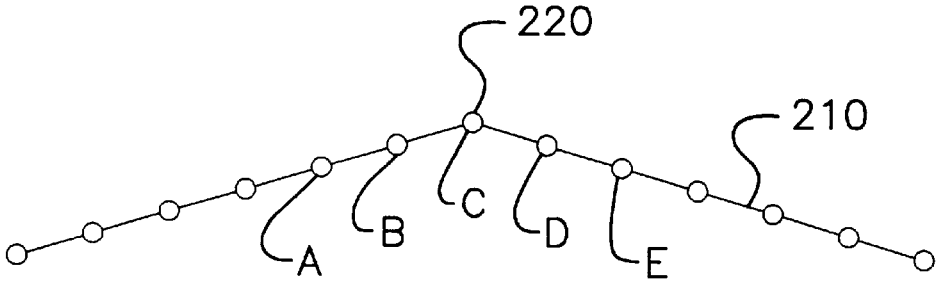
FIG. 7 is a diagrammatic illustration of an aspect for determining a point of discontinuity.

In an alternate embodiment, the geographical location of the crown is not stored in the database 340, but must be determined by other methods. One method of determining the location of the crown in (x,y,z) coordinates is illustrated in FIGS. 7 and 9.

Figure 9:
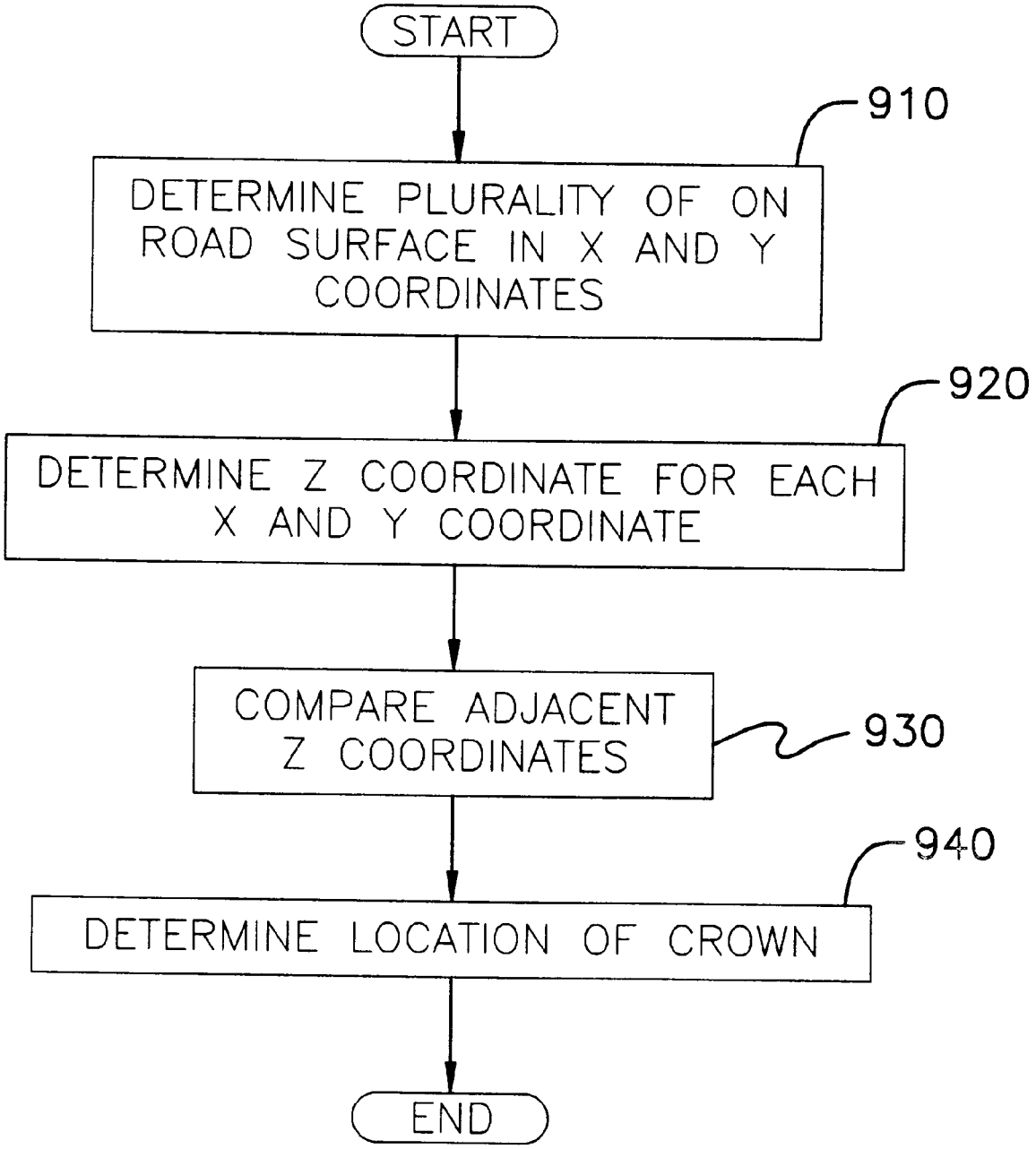
FIG. 9 is a flow diagram illustrating another aspect of the present invention.

In a first control block 910 in FIG. 9, a plurality of points is determined on a line on the road surface 210 that is essentially transverse to the longitudinal direction of the road. The line is defined by projecting the coordinates of the cutting edge 130 into the terrain database 340. A series of points (A, B, C, D, E) are shown in FIG. 7. The points are defined in x and y coordinates.

In a second control block 920, a z coordinate is determined for each corresponding x and y coordinate from terrain data in the database 340.

Control proceeds to a third control block 930, where the z coordinate of each point is compared to the z coordinates of the adjacent points. In the example shown in FIG. 7, point (B) is compared to points (A,C), point (C) is compared to points (B,D), and point (D) is compared to points (C,E).

In the comparison, it is determined if the three points lie on a line segment of constant slope, or if the slope changes direction at a point. For example, the line segment defined by points (A,B,C) would have a constant slope, but the line segment defined by points (B,C,D) have a slope that changes direction at point (C).

In a fourth control block 940, the location of the crown 220 on the line is determined. In the example in FIG. 7, the point (C) is determined to be the location of the crown 220 since the comparison of the points indicates the point of discontinuity is point (C).

An alternate method of determining the location of the crown 220 is to compare the z coordinates of the points on the line and choose the point with the highest elevation as the location of the crown 220. It is to be understood that other methods to determine the location of the crown may be used without deviating from the present invention.

Referring back to FIG. 8, in a second control block 820, one of the two sloped grades located on either side of the crown 220 is chosen to position the earthworking implement 120 for cutting the terrain. Preferably, the sloped grade is chosen where the longest portion of the cutting edge 130 is located. This would allow for the most efficient work performance as the earthworking machine 110 traverses the road surface 210.

In a third control block 830, the cutting edge 130 is positioned on the chosen sloped grade of the road surface 210. The first end 230 of the cutting edge 130 is positioned on the road surface 210 at coordinate ($x_2$, $y_2$, $z_2$).

Proceeding to a fourth control block 840, the x and y coordinates of the second end 240 of the cutting edge 130 are determined. The z coordinate of the road surface 210 at the determined x and y coordinates is found in the database 340. These coordinates are referred to in any of FIGS. 4, 5, and 6 as ($x_3$, $y_3$, $z_3$). Control then proceeds to a fifth control block 850, where a desired z' coordinate is determined to replace $z_3$ so that ($x_3$, $y_3$, z') becomes the desired position of the second end 240.

Figure 6:
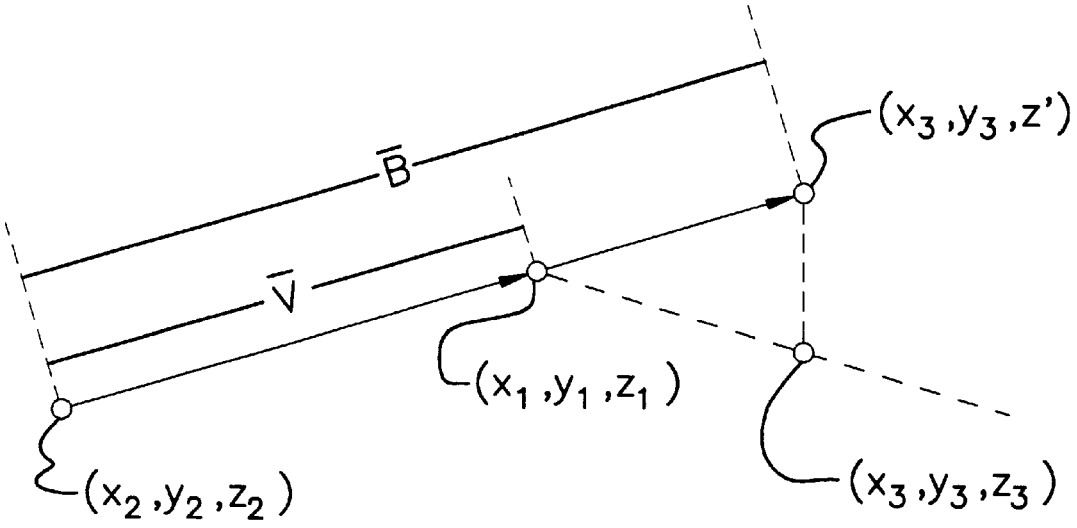
FIG. 6 is a vector diagram illustrating an embodiment of the present invention.
Figure 10:
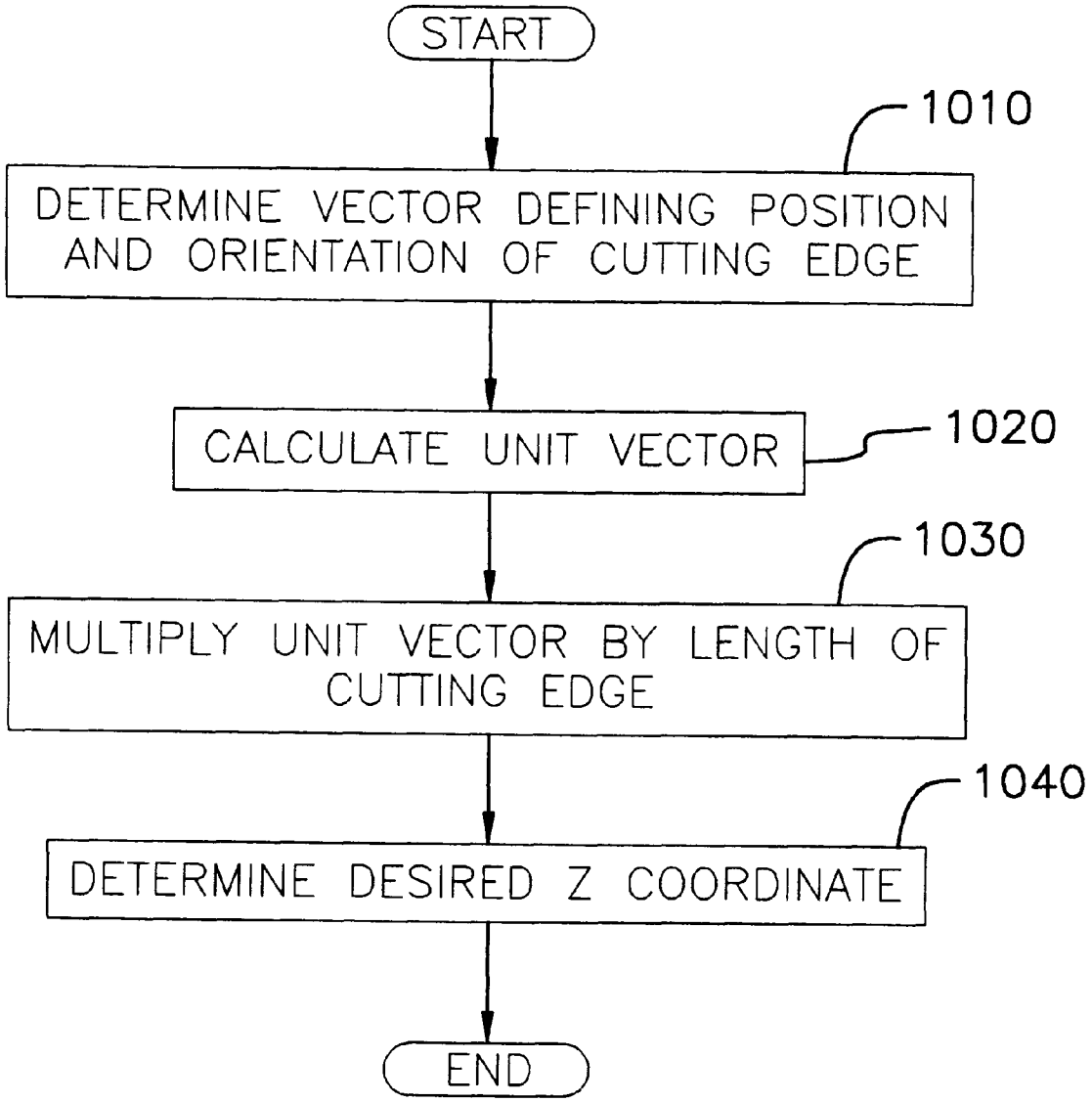
FIG. 10 is a flow diagram illustrating yet another aspect of the present invention.

Referring to FIGS. 6 and 10, a method for determining z' is shown.

In a first control block 1010, a vector defining the position and orientation of the cutting edge 130 is determined. The vector (V) shown in FIG. 6 originates at point ($x_2$, $y_2$, $z_2$) and ends at point ($x_1$, $y_1$, $z_1$). The coordinates of both points are known. Therefore, the vector (V) is known.

In a second control block 1020, a unit vector (u) for the vector (V) is calculated using standard mathematical techniques. Control then proceeds to a third control block 1030, where the unit vector (u) is multiplied by the known length of the cutting edge 130 to determine a vector (B), which is shown in FIG. 6 as originating at point ($x_2$, $y_2$, $z_2$) and ending at point ($x_2$, $y_2$, z').

Proceeding to a fourth control block 1040, the coordinate z' is determined from the vector (B) and point ($x_2$, $y_2$, $z_2$)

Considering the above vector method in more detail, the vector (V) is defined as:

$$(V)=(x_1-x_2,y_1-y_2,z_1-z_2) \quad \text{(Eq. 1)}$$

The magnitude of (V) is determined as:

$$|V| = V_L = \sqrt{(x_1-x_2)^2+(y_1-y_2)^2+z_1-z_2)^2} \quad \text{(Eq. 2)}$$

The next step is to find the unit vector (u).

$$(u) = \frac{1}{V_L}(V) = \left\langle \frac{x_1-x_2}{V_L}, \frac{y_1-y_2}{V_L}, \frac{z_1-z_2}{V_L} \right\rangle \quad \text{(Eq. 3)}$$

Multiplying (u) by the known length of the cutting edge 130:

$$(B) = |B|(u) = \left\langle \frac{B_L(x_1-x_2)}{V_L}, \frac{B_L(y_1-y_2)}{V_L}, \frac{B_L(z_1-z_2)}{V_L} \right\rangle \quad \text{(Eq. 4)}$$

where (B) is the vector defining the cutting edge 130.

The vector (B) is also defined as:

$$(B)=(x_3-x_2,y_3-y_2,z'-z_2) \quad \text{(Eq. 5)}$$

Equating the third terms of the equivalent (B) equations (Eqs. 4 and 5):

$$z' - z_2 = \frac{B_L(z_1 - z_2)}{V_L} \quad \text{(Eq. 6)}$$

which, solving for z', can be rewritten as:

$$z' = \frac{B_L(z_1 - z_2)}{V_L} + z_2 \quad \text{(Eq. 7)}$$

Substituting the equivalence of $V_L$ from (Eq. 2), an equation for z' is shown in (Eq. 8).

$$z' = \frac{B_L(z_1 - z_2)}{\sqrt{(x_1 - x_2)^2 + (y_1 - y_2)^2 + (z_1 - z_2)^2}} + z_2 \quad \text{(Eq. 8)}$$

As can be seen from (Eq. 8), the only variables required to determine z' are the length of the cutting edge 130 and the (x, y, z) coordinates for the first end 230 and the crown 220.

Industrial Applicability

As an example of an application of the present invention, a motor grader that grades a road surface 210 to a desired final contour is described in relation to FIG. 2. The contour of the road surface 210 includes a crown 220 along the longitudinal center of the road to allow the road to slope downwardly from the center to the sides. The sloped road surface 210 can then allow water to drain off the road quickly.

The blade of the motor grader is positioned on a sloped grade on one side of the crown 220 so that one end of the blade overlaps the crown 220 as the motor grader traverses the road and cuts the desired contour. Overlapping the crown 220 by the blade in this manner prevents the crown 220 from being missed or cut into as the motor grader bounces or moves from side to side during forward motion.

If a computer-aided earthworking system is used on the motor grader, the system determines that the desired position of the end of the blade that overlaps the crown 220 is on the road surface 210. This determination would cause a portion of the blade to be lower than the crown 220 and consequently remove the crown 220.

The present invention provides a method to determine a position for the overlapping end of the blade at a higher elevation than the previously determined position on the road surface 210. This new position allows the blade to cut the road contour without removing or cutting into the crown 220.

Other aspects, objects, and features of the present invention can be obtained from a study of the drawings, the disclosure, and the appended claims.

We claim:

1. A method for controlling an earthworking implement to preserve a crown on a road surface, the road surface having a sloped grade on each side of the crown, the earthworking implement having a cutting edge and being controllably mounted on an earthworking machine, including the steps of:

determining the position of at least one point of discontinuity of said sloped grade on said road surface, said at least one point of discontinuity being a location of said crown, the location of said crown having a known first x, y, and z coordinate ($x_1$, $y_1$, $z_1$);

choosing a sloped grade road surface located on one of two sides of said crown;

positioning said cutting edge on said sloped grade road surface at a position for a desired cut, said cutting edge having a first end located on said sloped grade road surface, said first end having a known second x, y, and z coordinate ($x_2$, $y_2$, $z_2$) ; and determining a desired position of a second end of said cutting edge, said second end having a known third x and y coordinate ($x_3$, $y_3$), and a known third z coordinate ($z_3$) corresponding to a position on said road surface at said known third x and y coordinate, including the step of determining a desired z coordinate (z') as a function of said known first and second x, y, and z coordinates, said desired z coordinate being determined to replace said known third z coordinate.

2. A method, as set forth in claim 1, wherein determining the position of at least one point of discontinuity includes the step of determining a point of discontinuity from a predetermined line of discontinuity located in a site database, said line of discontinuity being the crown of said road surface.

3. A method, as set forth in claim 1, wherein determining the position of at least one point of discontinuity includes the steps of:

determining a plurality of points on said road surface along a line extending from a first side of said road surface to a second side of said road surface, each point having a known x and y coordinate;

determining a z coordinate for each x and y coordinate from a site database;

comparing the z coordinate of each point to the z coordinates of the points located adjacent said point; and determining the location of said crown in response to said comparison.

4. A method, as set forth in claim 3, wherein determining the location of said crown includes the steps of:

calculating a slope of a line defined by the z coordinates of said points; and determining the location of said crown in response to the slope of said line changing direction.

5. A method, as set forth in claim 3, wherein determining the location of said crown includes the step of determining the z coordinate with a magnitude greater than the remaining z coordinates.

6. A method, as set forth in claim 1, wherein choosing a sloped grade road surface includes choosing the sloped grade road surface on the side of said crown where more than one half of the length of said cutting edge is located.

7. A method, as set forth in claim 1, wherein determining a desired position of a second end of said cutting edge includes the steps of:

determining a vector defining the position and orientation of said cutting edge;

calculating a unit vector of said vector;

multiplying said unit vector by the length of said cutting edge; and determining said desired z coordinate (z') as a function of said vector, said unit vector, and the length of said cutting edge.

8. A method, as set forth in claim 7, wherein determining a vector includes the step of calculating said vector as a function of said first x, y, and z coordinate ($x_1$, $y_1$, $z_1$) and said second x, y, and z coordinate ($x_2$, $y_2$, $z_2$).

9. A method, as set forth in claim 1, wherein determining a desired position of a second end of said cutting edge is performed by calculating the equation:

$$z' = \frac{B_L(z_1 - z_2)}{\sqrt{(x_1 - x_2)^2 + (y_1 - y_2)^2 + (z_1 - z_2)^2}} + z_2$$

where $B_L$ is a known length of said cutting edge.

10. A method, as set forth in claim 1, including the step of positioning the second end of said cutting edge at said desired z' coordinate.

11. A method for controlling an earthworking implement to preserve a crown on a road surface, the road surface having a sloped grade on each side of the crown, the earthworking implement having a cutting edge and being controllably mounted on an earthworking machine, including the steps of:

determining the position of at least one point of discontinuity of said sloped grade on said road surface, said at least one point of discontinuity being a location of said crown;

choosing a sloped grade road surface located on one of two sides of said crown;

positioning said cutting edge on said sloped grade road surface at a position for a desired cut, said cutting edge having a first end located on said sloped grade road surface; and determining a desired position of a second end of said cutting edge, said second end having a desired elevation.

12. A method, as set forth in claim 11, wherein determining the position of at least one point of discontinuity includes the step of determining a point of discontinuity from a predetermined line of discontinuity located in a site database, said line of discontinuity being the crown of said road surface.

13. A method, as set forth in claim 11, wherein determining the position of at least one point of discontinuity includes the steps of:

determining a plurality of points on said road surface along a line extending from a first side of said road surface to a second side of said road surface;

determining an elevation for each point from a site database;

comparing the elevation at each point to the elevations at the points located adjacent said point; and determining the location of said crown in response to said comparison.

14. A method, as set forth in claim 13, wherein determining the location of said crown includes the steps of:

calculating a slope of a line defined by the elevations at said points; and determining the location of said crown in response to the slope of said line changing direction.

15. A method, as set forth in claim 13, wherein determining the location of said crown includes the step of determining the point with an elevation greater than the remaining points.

16. A method, as set forth in claim 11, wherein choosing a sloped grade road surface includes choosing the sloped grade road surface on the side of said crown where more than one half of the length of said cutting edge is located.

17. A method, as set forth in claim 11, wherein determining a desired position of a second end of said cutting edge includes the steps of:

determining a vector defining the position and orientation of said cutting edge;

calculating a unit vector of said vector;

multiplying said unit vector by the length of said cutting edge; and determining said desired elevation as a function of said vector, said unit vector, and the length of said cutting edge.

18. A method, as set forth in claim 17, wherein determining a vector includes the step of calculating said vector as a function of the location of said crown and the location of the first end of said cutting edge.

19. A method, as set forth in claim 11, including the step of positioning the second end of said cutting edge at said desired elevation.

20. An apparatus for controlling an earthworking implement to preserve a crown on a road surface, the road surface having a sloped grade on each side of the crown, the earthworking implement having a cutting edge with a first end and a second end, the earthworking implement being controllably mounted on an earthworking machine, comprising:

a position determining system mounted on said earthworking machine;

a control system located on said earthworking machine and adapted to receive a position signal from said position determining system and responsively determine a position of said earthworking machine;

a database associated with said control system, said database including data related to a desired and an actual geographic terrain of a work site; and processing means for accessing said database and determining a position of the first end of said cutting edge, determining a position of said crown, and responsively calculating a desired position of the second end of said cutting edge.

21. An apparatus, as set forth in claim 20, wherein said position determining system includes a position determining receiver.

22. An apparatus, as set forth in claim 21, wherein said position determining receiver is a GPS receiver.

23. An apparatus, as set forth in claim 20, wherein said processing means includes a processor associated with said control system.

24. An apparatus, as set forth in claim 20, wherein said database further includes data related to the location of the crown on said road surface.

25. An apparatus, as set forth in claim 20, wherein said processing means further includes means for determining the location of the crown on said road surface.

* * * * *